US007011026B2

(12) United States Patent
Christel et al.

(10) Patent No.: US 7,011,026 B2
(45) Date of Patent: Mar. 14, 2006

(54) METHOD FOR ENGAGING AND DISENGAGING CYLINDERS

(75) Inventors: Ralf Christel, Aschbach (DE); Oliver Frank Hahn, Veitshöchheim (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 92 days.

(21) Appl. No.: 10/484,434

(22) PCT Filed: Aug. 2, 2002

(86) PCT No.: PCT/DE02/02867

§ 371 (c)(1),
(2), (4) Date: Jan. 28, 2004

(87) PCT Pub. No.: WO03/013856

PCT Pub. Date: Feb. 20, 2003

(65) Prior Publication Data

US 2004/0231534 A1 Nov. 25, 2004

(30) Foreign Application Priority Data

Aug. 3, 2001 (DE) ..... 101 38 221

(51) Int. Cl.
*B41C 1/54* (2006.01)

(52) U.S. Cl. ..... 101/483; 101/212; 101/219; 101/247

(58) Field of Classification Search ..... 101/483, 101/212, 219, 247
See application file for complete search history.

(56) References Cited

U.S. PATENT DOCUMENTS

| | | | |
|---|---|---|---|
| 4,125,073 | A | 11/1978 | Bain |
| 4,598,640 | A | 7/1986 | Nawrath |
| 5,692,439 | A | 12/1997 | Wech |
| 5,868,071 | A | 2/1999 | Niemiro et al. |
| 5,953,991 | A | 9/1999 | Geissenberger et al. |
| 6,019,039 | A | 2/2000 | Knauer et al. |
| 6,032,579 | A | 3/2000 | Richards |
| 6,050,185 | A | 4/2000 | Richards |
| 6,374,731 | B1 | 4/2002 | Walczak et al. |
| 6,397,743 | B1 | 6/2002 | Dauer et al. |
| 6,408,747 | B1 | 6/2002 | Koppelkamm et al. |
| 6,494,138 | B1 | 12/2002 | Gottling et al. |
| 2002/0178946 | A1 | 12/2002 | Hahn |
| 2002/0178947 | A1 | 12/2002 | Hahn |

FOREIGN PATENT DOCUMENTS

| | | |
|---|---|---|
| CH | 345906 | 6/1960 |
| DE | 34 12 812 C1 | 6/1985 |
| DE | 91 09 833.5 U1 | 10/1991 |
| DE | 44 15 711 A1 | 11/1995 |
| DE | 198 15 294 A1 | 10/1998 |

(Continued)

*Primary Examiner*—Ren Yan
*Assistant Examiner*—Andrea H. Evans
(74) *Attorney, Agent, or Firm*—Jones Tullar & Cooper, PC

(57) ABSTRACT

A method for engaging and disengaging cylinders, and particularly cylinders which are disposed in a line, is disclosed. In addition to the displacement required to engage and to disengage the cylinders, steps are taken to at least reduce the relative tangential speed between the working outer surfaces of the cylinders that are to be engaged against one another or against an intermediate web. This is accomplished by the reduction of, or the impression upon the cylinders of a specific rotational speed.

13 Claims, 8 Drawing Sheets

FOREIGN PATENT DOCUMENTS

| | | | |
|---|---|---|---|
| DE | 198 03 809 | A1 | 8/1999 |
| DE | 199 37 796 | A1 | 2/2001 |
| DE | 199 61 574 | A1 | 7/2001 |
| EP | 0 862 999 | A2 | 9/1998 |
| EP | 0 878 302 | A1 | 11/1998 |
| EP | 1 075 945 | A1 | 2/2001 |
| JP | 57131561 | A | 8/1982 |
| JP | 10071694 | A | 3/1998 |

METHOD FOR ENGAGING AND DISENGAGING CYLINDERS

FIELD OF THE INVENTION

The present invention is directed to a method for engaging or disengaging cylinders from each other or from an intervening web. The speeds and directions of movement of the cylinders may be changed.

BACKGROUND OF THE INVENTION

EP 0 878 302 A1 discloses the engagement and disengagement of a cylinder. In the course of pivoting, the cylinder is controlled by an eccentric device in such a way that adjoining cylinders do not perform a sliding movement. The pivot movement of the cylinder by the eccentric device is controlled in such a way that the cylinder's rotation coincides with a roll-off movement of an adjoining cylinder.

EP 0 862 999 A2 discloses a double printing group with two transfer cylinders which are working together and which are seated in eccentric, or in double eccentric bushings, for the purpose of being placed against or away from other cylinders. In another embodiment, these transfer cylinders are seated on levers, which levers are seated eccentrically in respect to the forme cylinder shaft and are pivotable.

For the purpose of engaging or disengaging the transfer cylinders in U.S. Pat. No. 5,868,071, these cylinders are seated in carriages which are linearly displaceable in the lateral frame along parallel movement directions in linear guide elements having linear bearings.

SUMMARY OF THE INVENTION

The object of the present invention is directed to providing a method for engaging or disengaging cylinders.

In accordance with the present invention, this object is attained by providing a method for engaging or disengaging one cylinder from another cylinder or engaging or disengaging one cylinder from a web which is interposed between it and another cylinder. The cylinder is moved along a movement path that may be either parallel or not parallel with a web movement path. When the cylinder is near the web, its speed is adjusted so that it may more closely match either the web speed or the speed of the cooperating cylinder. The speed of one cylinder may increase while the speed of the other cylinder may decrease.

The advantages which can be gained by the present invention lie, in particular, in that the possibility of an assured and/or low-wear disengagement is provided by the present method in case of a web break. An advantageous variation makes possible a rapid and assured print-off operation without a large mechanical outlay.

The method for engaging or disengaging cylinders in accordance with the present invention is particularly suited for printing groups of a printing press which, for example, because of the linear arrangement of the cylinders, is constructed in a compact, low-oscillation and rugged manner.

Minimizing the number of parts which must be movable for normal operations and during setup, for example relinquishment of the movement of all of the cylinders, frame walls, bearings and the like, assures a rugged and cost-effective construction.

Also, in the attainment of a rugged and a simple construction, it is advantageous if only the transfer cylinders need to be moved for bringing the printing group into or out of contact with other groups. Although the forme cylinders can be movably seated for adjusting the distance of the forme cylinder to the associated transfer cylinder, as well as to a possible inking system and, if provided, a dampening system, the placement, either against or away from each other of the transfer cylinders and the associated forme cylinders, takes place in an advantageous manner only by a movement of the transfer cylinders.

The linear arrangement of the cylinders is made possible by a specially selected movement in the area of the printing position. At the same time, engagement and disengagement devices are avoided.

In one embodiment of the method of the present invention, the transfer cylinders, which may be seated in carriages, for example, in linear guide devices, in or on the lateral frame, are a moved substantially perpendicular with respect to a plane of the axes of the cylinders.

In another embodiment of the present invention, the transfer cylinders are arranged on levers to accomplish this movement, which levers are seated eccentrically pivotable with respect to the forme cylinder axis.

In a third embodiment of the present invention, the transfer cylinders are seated in double-eccentric bushings, which makes possible a movement of the transfer cylinders which is almost linear and which, to a large extent, is perpendicular to the plane of the cylinder axes, at least in the area near the printing position.

Cylinders, or rollers, of printing groups must be moved away from each other, out of an operating state, called "print on", i.e. a print-on position, and then back into contact with each other to accomplish washing, and changing of dressings in particular. The radial movement direction of the rollers required for this cylinder or roller movement also contains a movement component in a tangential direction, whose size is a function of the structural configuration, such as eccentric cam, lever, linear guide device, as well as their angle in respect to the nip point, of the setting device. If a speed difference is created on the active jacket surfaces, at the nip point, because of the setting in relation to the operational state, this implies, because of the surface friction of the roller materials used, a tangential frictional force component which is directed opposite the setting movement. Therefore, the setting movement is slowed by this, or its speed is limited. This is important, in particular with printing group cylinders in case of so-called "windings", since there large frictional forces also result from the high pressures occurring.

It is therefore advantageous, in a method for engaging or disengaging cylinders with each other, that any relative tangential speed in the area near the contact, i.e. in the area of the nip point, of two cylinders or rollers working together, is reduced by effecting an intentional rotation, or turning, of at least one of the affected cylinders or rollers.

Besides a reduction of the slowing of the setting, an unnecessarily high load, such as caused by friction or deformation on the dressings and/or on the jacket surfaces of the involved cylinders or rollers, is prevented.

BRIEF DESCRIPTION OF THE DRAWINGS

Preferred embodiments of the present invention are represented in the drawings and will be described in greater detail in what follows.

Shown are in:

FIG. 1, a schematic representation of a double printing group, in

DESCRIPTION OF THE PREFERRED EMBODIMENTS

Figure 1:
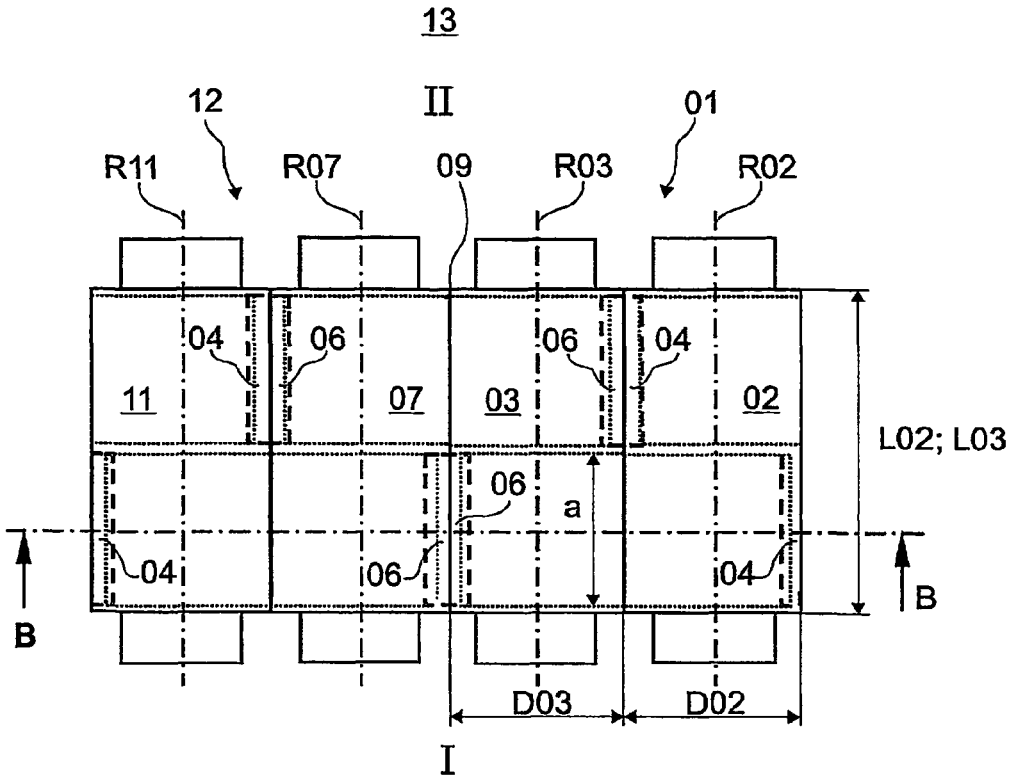

A first printing group 01 of a printing press, and in particular of a rotary printing press, as seen in FIG. 1, has a first cylinder 02, for example a forme cylinder 02, and an associated second cylinder 03, for example a transfer cylinder 03.

On their circumferences, the forme cylinder 02 and the transfer cylinder 03 each have at least one interference in the circumferential direction on the jacket surface. This at least one interference may be, for example, a disruption 04, 06 in the jacket surface, which is active during roll-off. This disruption 04, 06 can be a joint between leading and trailing ends of one or of several dressings, which are arranged or secured on the cylinder circumference, for example by a magnetic force or by material-to-material contact. However, as will be discussed in what follows, in the preferred embodiments, these interferences or disruptions 04, 06 can also be grooves 04, 06, or slits 04, 06, which receive ends of dressings. The interferences, called grooves 04, 06 in what follows, are equivalent to other interruptions 04, 06 on the active jacket surface, i.e. the outward pointing face of the cylinders 02, 03 provided with dressings.

Each of the forme cylinders 02 and transfer cylinders 03 has at least two grooves 04, 06, or interruptions 04, 06. These two grooves 04, 06 are respectively arranged one behind the other in the longitudinal direction of the cylinders 02, 03, and are offset in respect to each other in the circumferential direction.

If the cylinders 02, 03 only have a length L02, L03, which substantially corresponds to two widths of a newspaper page, only two grooves 04 and 06 are provided, which are offset in respect to each other in the circumferential direction and are arranged one behind the other in the longitudinal direction.

The grooves 04, 06 are arranged on the two cylinders 02, 03 in such a way that, in the course of a rotation of the two cylinders 02, 03, they roll off on respectively one of the grooves 06, 04 of the other cylinder 03, 04. The offset of the grooves 04, 06 of each cylinder 02, 03 in the circumferential direction is preferably approximately 180°. Therefore, after respectively one 180° rotation of the cylinders 02, 03, at least one pair of grooves 04, 06 rolls off on each other, while on a longitudinal section "a" of the cylinders 02, 03, as seen in FIG. 1, the cylinders 02, 03 roll off unimpeded on each other.

Figure 2:
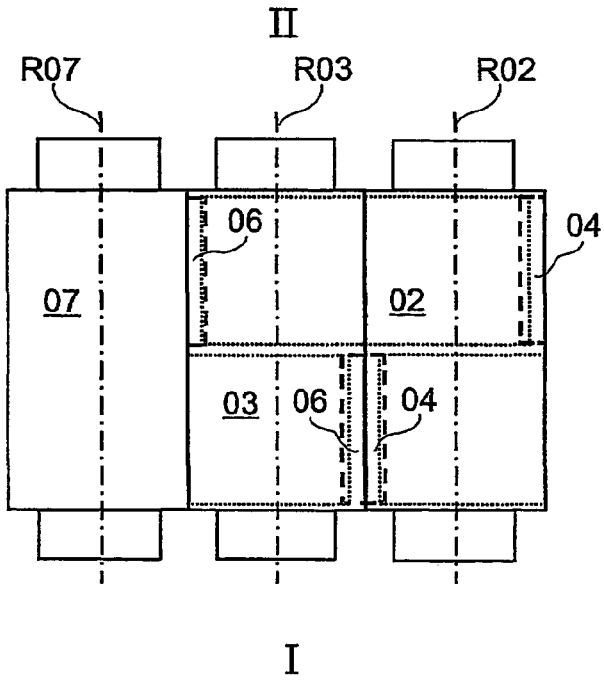
FIG. 2, a schematic representation of a three-cylinder offset printing group, in FIG. 3, a schematic representation of a double-wide double printing group, in FIG. 4, a schematic representation of a double-wide double printing group, which is highly symmetrical, in FIG. 5, a schematic representation of a double printing group taken along a section line B—B in FIG. 1, with a linear setting track, in FIG. 6, a schematic representation of a double printing group taken along a section line B—B in FIG. 1, with a curved setting track, in FIG. 7, a schematic side elevation view of an H-printing group with a linear setting track, and with cylinder driving in pairs, in FIG. 8, a schematic side elevation view of an H-printing group with a curved setting track, and with cylinder driving in pairs, in FIG. 9, a side elevation view of a linear guide device for transfer cylinders, and in FIG. 10, a cross-sectional view through the linear guide device in FIG. 9.

The transfer cylinder 03 of the first printing group 01 forms a printing position 09, together with a third cylinder 07, via a web 08, for example a web 08 of material to be imprinted. This third cylinder 07 can be embodied as a second transfer cylinder 07, as shown in FIG. 1, or as a counter-pressure cylinder 07, as shown in FIG. 2, for example as a steel cylinder or a satellite cylinder 07.

Figure 5:
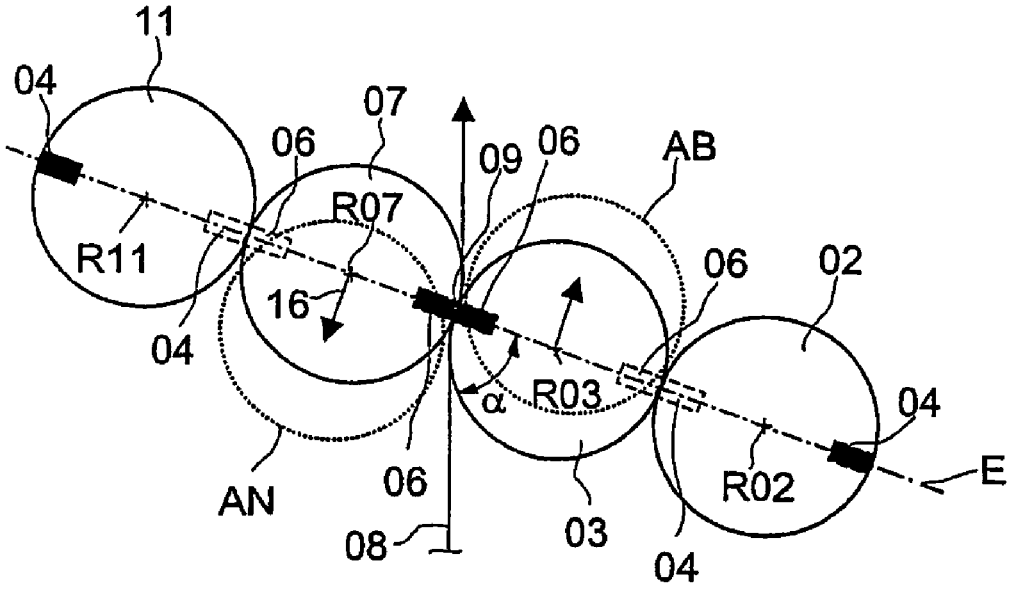
Figure 6:
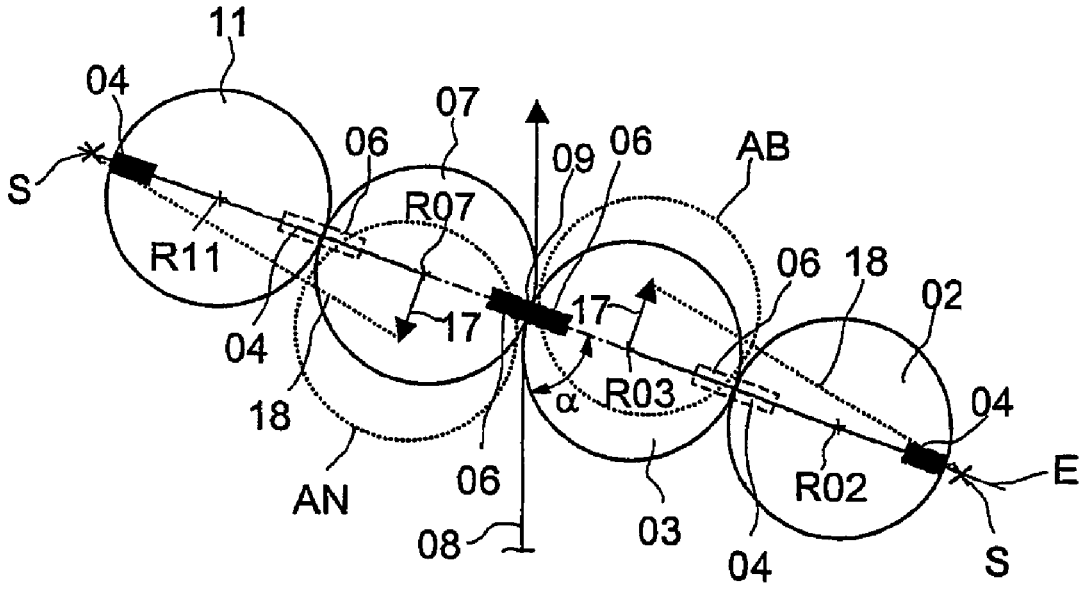

In the print-on position AN, the rotating shafts R02, R03, R07 of the three cylinders 02, 03, 07 working together are substantially located on a common plane E and extend parallel with each other as seen in FIGS. 5 and 6. If the satellite cylinder 07 has two printing positions on its circumference, a second printing group, which is not specifically represented, is also arranged on the common plane E.

As represented in the preferred embodiment in FIG. 1, the third cylinder 07, embodied as the second transfer cylinder 07, works together with a fourth cylinder 11, in particular a second forme cylinder 11 with an rotating shaft R11 and constitutes a second printing group 12. The two separate printing groups 01, 12 constitute a combined printing group 13, a so-called double printing group 13, which imprints both sides of the web 08 simultaneously.

During printing, i.e. in the print-on position AN, all of the rotating shafts R02, R03, R07, R11 of the four cylinders 02, 03, 07, 11 are located in the common plane E and extend parallel with each other.

In the case of the double printing group 13, shown in FIG. 1, the cylinders 07, 11 of the second printing group 12 also have grooves 04, 06 with the properties regarding the number and offset in respect to each other already described above in connection with the first printing group 01. Now the grooves 04, 06 of the four cylinders 02, 03, 07, 11 are preferably arranged in such a way that respectively two grooves 04, 06 of two cylinders 02, 03, 07, 11 which work together roll off on each other.

Figure 3:
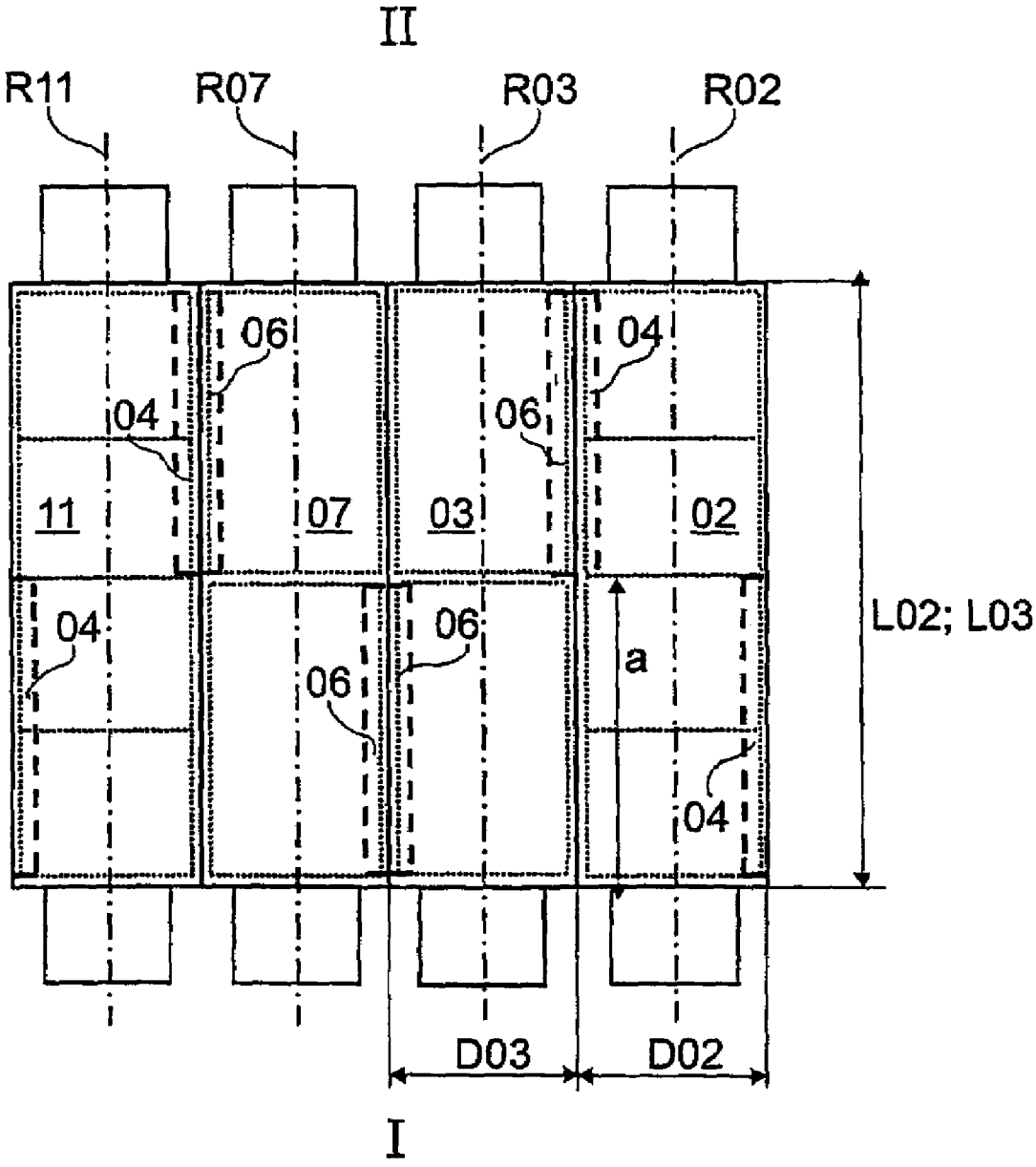
Figure 4:
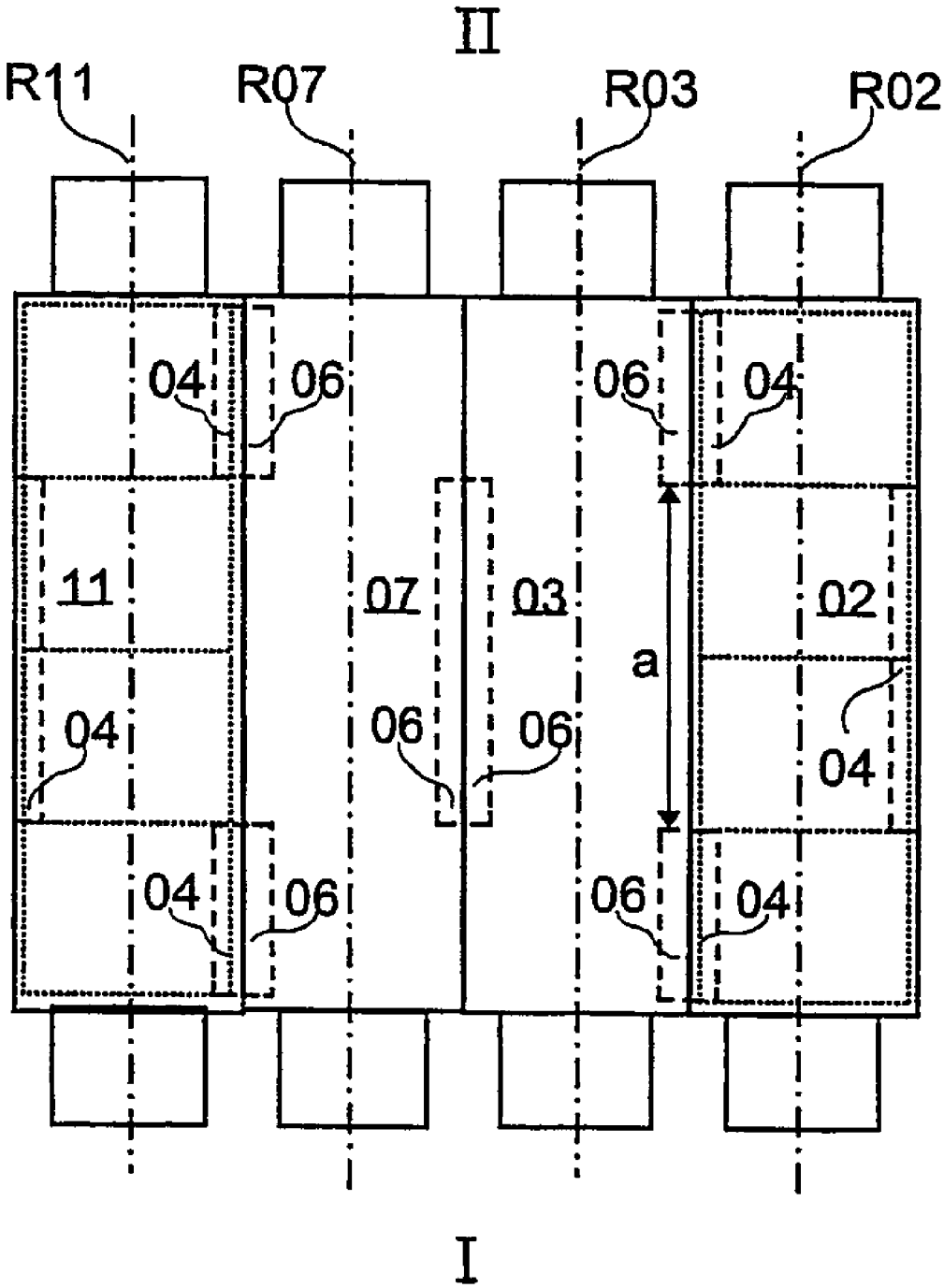

In an advantageous embodiment, the forme cylinder 02 and the transfer cylinder 03 each have a length L02, L03, which corresponds to four or more widths of a printed page, for example a newspaper page, for example 1,100 to 1,800 mm, and in particular 1,500 to 1,700 mm, and a diameter D02, D03, for example 130 to 200 mm, and in particular of 145 to 185 mm, whose circumference substantially corresponds to the length of a newspaper page as seen in FIGS. 3 and 4.

More than two grooves 04, 06 can be arranged per cylinder 02, 03. In this case, respectively two grooves 04, 06 arranged next to each other can be arranged aligned, or respectively alternatingly. However, for example with four grooves 04, 06, the two grooves 04, 06 adjoining the front ends of the cylinders 02, 03 can be arranged in a common alignment, and the two grooves 04, 06 located on the "inside" can be arranged in a common alignment, but offset in the circumferential direction in respect to the first mentioned ones, as depicted in FIG. 4.

If the interruptions 04, 06 are actually embodied as grooves 04, 06, or as slits 04, 06, the grooves 04, 06 schematically represented in FIGS. 1 to 4 can be slightly longer than the width, or twice the width of the printed page. Possibly two grooves 04, 06 adjoining each other in the longitudinal direction can also slightly overlap in the circumferential direction. This is not shown in detail in FIGS. 1 to 4, which are only schematic representations.

In view of the excitation, or the damping of oscillations caused by groove beating, it is particularly advantageous if the grooves 04, 06 on the respective cylinders 02, 03, 07, 11 are offset by 180° from each other. In this case, the grooves 04, 06 between the forme cylinders 02, 11 and the transfer cylinders 03, 07 of the two printing groups 01, 12 roll off simultaneously and in the area of the same section in the longitudinal direction of the cylinders 02, 03, 07, 11, in one stage of the cycle for example on the same side, for example a side I, as seen in FIGS. 1, 3 and 4 of the double printing group 13, and in the other phase on a side II or, with more than two grooves 04, 06 per cylinder 02, 03, 07, 11, for example in the area of the center of the cylinders 02, 03, 07, 11.

The excitation of oscillations is considerably reduced by the linear arrangement of the cylinders 02, 03, 07, 11 in one plane E, the offset arrangement of the grooves 04, 06 and the roll-off of all grooves 04, 06 in the described manner. Because of the synchronous and symmetrical roll-off on the two printing groups 01, 12, a destructive interference with the excitation occurs which, with the selection of the offset by 180° of the grooves 04, 06 on the cylinders 02, 03, 07, 11, takes place independently of the number of revolutions of the cylinders 02, 03, 07, 11, or of the frequency.

If the interruptions 04, 06 are actually embodied as grooves 04, 06, in an advantageous embodiment they are embodied with a gap of only narrow width, for example less than or equal to 3 mm, in the area of a jacket surface of the forme cylinders 02, 11, or of the transfer cylinders 03, 07, which gap receives ends of one or several dressings, for example one or several rubber blankets on the transfer cylinder 03, 07, or ends of one or several dressings, for example one or several printing plates, on the forme cylinders 02, 11. The dressing on the transfer cylinder 03, 07 is preferably embodied as a so-called metallic printing blanket, which has an ink-conducting layer on a metallic base plate. In the case of the transfer cylinders 03, 07, the beveled edges of the dressings are secured by clamping and/or bracing devices, and in the case of forme cylinders 02, 11 by clamping devices, in the grooves 04, 06.

A single, continuous clamping and/or bracing device can be arranged in each one of the grooves 06 of the transfer cylinder 03 or, in case of grooves extending over several widths of newspaper pages, several clamping and/or bracing devices can be arranged one behind the other in the longitudinal direction. The grooves 04 of the forme cylinder 02, for example, also have a single, or several clamping devices.

A "minigap technology" is preferably employed in the grooves 04 of the forme cylinders 02, 11, as well as in the grooves 06 of the transfer cylinders 03, 07, wherein a leading dressing end is inserted into a narrow groove 04, 06 with an inclined extending suspension edge, the dressing is wound on the cylinders 02, 03, 07, 11, the trailing end is also pushed into the groove 04, 06, and the ends are clamped, for example by use of a rotatable spindle or a pneumatic device, to prevent them from sliding out.

However, it is also possible to arrange a groove 04, 06 which receives the ends of the dressings and which is embodied as a narrow slit 04, 06 without a clamping device for the dressing on the forme cylinders 02, 11, as well as for the dressing embodied as a metallic printing blanket of the transfer cylinders 03, 07. In this case the plate or blanket ends are secured in the slit 04, 06 by their shaping and/or by the geometry of the slit 04, 06, for example.

For example, in an advantageous embodiment as depicted in FIG. 3, the transfer cylinders 03, 07 have only two dressings, which are offset by 180° from each other in the circumferential direction, each of which dressings has at least a width corresponding to two widths of a newspaper page. In this case, the dressings, or the grooves 04 of the forme cylinders 02, 11, extending complementary thereto must have either, as represented, two continuous grooves 04, each of the length of two widths of a newspaper page, or grooves 04 which adjoin in pairs and are arranged aligned, each of a length of a newspaper page. In the first case, in an advantageous embodiment, each interruption 04 of the forme cylinder 02, 11 actually embodied as a groove 04 which has two clamping devices, each of a length substantially corresponding to the width of a newspaper page.

In an advantageous embodiment, the forme cylinders 02, 11 are covered with four flexible dressings, which are arranged next to each other in the longitudinal direction of the forme cylinders 02, 11 and which have a length of slightly greater than the length of a printed image of a newspaper page in the circumferential direction, and in the longitudinal direction have a width of approximately one newspaper page. With the arrangement of continuous grooves 04 and with only one clamping device per groove 04, 06, which has a length of two widths of a newspaper page, it is also possible to apply dressings of a width of two newspaper pages, which dressings are so-called panoramic printing plates.

In connection with printing groups for which the need for a setup with panoramic printing plates can be excluded, an arrangement can also be of advantage in which the "outer" dressings, which respectively adjoin the side I and the side II, are aligned with each other, and the "inner" dressings are aligned with each other and are arranged offset by 180° from the first mentioned ones, as seen in FIG. 4. This highly symmetrical arrangement makes it additionally possible to minimize, or to prevent, the danger of an oscillation excitation in the plane E, which might result from the non-simultaneous passage of the grooves 04, 06 on the sides I and II. The alternating tensing and relaxation of the web 08 occurring alternatingly on the sides I and II, and oscillations of the web 08 caused thereby, can also be avoided by this.

In a further development, the above-mentioned linear arrangement of the cylinders 02, 03, 07, 11, and the arrangement of the interruptions 04, 06 on the respective cylinders 02, 03, 07, 11, as well as between the cylinders 02, 03, 07, 11, can in a further development be applied in particular to cylinders 02, 03, 07, 11 of a length L02, L03 substantially corresponding to six times the width of a newspaper page. However, in this case, it can be advantageous to embody the transfer cylinders 03, 07 and/or the forme cylinders 02, 11 with a diameter D02, D03 which results in a circumference which substantially corresponds to double the length of a newspaper page.

In an advantageous embodiment, for a mechanically simple and rugged embodiment of the double printing group 13, the forme cylinders 02, 11 are arranged fixed with respect to their rotating shafts R02, R11. For bringing the printing groups 01, 12 in and out of contact, the transfer cylinders 03, 07 are embodied to be movable by shifting their rotating shafts R03, R07, and can each be simultaneously moved away from their associated forme cylinders 02, 11 and transfer cylinders 03, 07 working together with them, or can be placed against them. In this embodiment, only the transfer cylinders 03, 07 are moved in the course of normal operation of the printing press, while the forme cylinders 02, 11 remain in their fixed and possibly previously adjusted position. However, the forme cylinders 02, 11 can also be seated in appropriate devices, for example in eccentric or double eccentric bushings, in linear guide devices or on levers, for adjustment, if necessary.

As represented schematically in FIGS. 5 and 6, the transfer cylinders 03, 07 can be movable along a linear setting track 16 which is shown in FIG. 5 or they can be movable along a curved setting track 17 which is shown in FIG. 6. The setting tracks 16 and 17, as well as the transfer cylinders 03, 04 in a print-off position AB, are represented in dashed lines in FIGS. 3 and 4.

The linear setting track 16 can be provided with the aid of linear guide devices, which are not specifically represented in FIG. 5, and which are arranged in or on the lateral frame, which is also not specifically represented in FIG. 5. For a rugged and low-oscillation construction, seating in a linear guide device is provided preferably on the side I and the side II of the double printing group 13.

A lever 18 is also schematically represented in FIG. 6, and in which lever 18 one of the transfer cylinders 03 is seated, and is rotatable around a pivot axis S. The pivot axis S lies preferably in the plane E. In an advantageous embodiment, the lever 18 is of a length, between the seating of the rotating shaft R03, R07 of the transfer cylinder 03, 07 and the pivot axis S, which length is greater than the distance of the rotating shaft R03, R07 of the transfer cylinder 03, 07 from the rotating shaft R02, R11 of the associated forme cylinder 02, 11 in the print-on position AN. Because of this, the simultaneous disengagement of cooperating transfer cylinders 03, 07 and of the associated forme cylinders 02, 11 takes place, and the opposite simultaneous movement occurs for engagement. However, the pivot axis S can also be arranged in a different way, eccentrically with respect to the rotating shaft R02, R11 of the associated forme cylinders 02, 11, for example, spaced apart from the plane E. Seating in a lever preferably takes place on the side I and the side II of the double printing group 13.

In a further embodiment, which is not specifically represented, the setting tracks 16, 17 are created by seating the transfer cylinders 03, 07 in eccentric bushings, which are not specifically represented, in particular in double eccentric bushings. It is possible, by the use of double eccentric bushings, to create a substantially linear setting track 16 in the area of the print-on position AN. In the area remote from the printing position 09, a curved setting track 17, when required, allows a more rapid, or greater removal of the transfer cylinders 03, 07 from the transfer cylinders 07, 03 working together with them, than from the associated forme cylinders 02, 11, or vice versa. The seating on the side I and on the side II of the double printing group 13 is also of advantage for the use of eccentric cams.

The course of the web 08 through the printing position 09, which printing position 09 is in the print-on position AN, is also represented in FIGS. 5 and 6. The plane E of the double printing group 13 and the plane of the web 08 intersect, in an advantageous embodiment, at an angle $\alpha$ of 70° to 85°, and in particular at an angle $\alpha$ of 75° to 80°. If the transfer cylinders 03, 07 have a circumference approximately corresponding to the length of one newspaper page, the angle $\alpha$ should advantageously be selected to be approximately 75°. If the transfer cylinders 03, 07 have a circumference approximately corresponding to two newspaper pages, the angle $\alpha$ should preferably be selected to be approximately 83°. For one, this selection of the angle $\alpha$ takes into account the assured and rapid access to the web 08 and/or the moving apart from each other of the transfer cylinders 03, 07 over a minimized setting track 16, 17, and also minimizes negative effects, such as mackling or smearing on the result of printing, which is decisively affected by the amount of a partial looping of the web around the transfer cylinder(s) 03, 07. In an optimal arrangement, the required linear setting track 16 of each transfer cylinder 03, 07 is less than or equal to 20 mm.

In an advantageous embodiment, at least one of the transfer cylinders 03, 07 can be disengaged to such an extent that the drawn-in web 08 can be conducted without contact through the printing position 09 during the printing operation.

Figure 7:
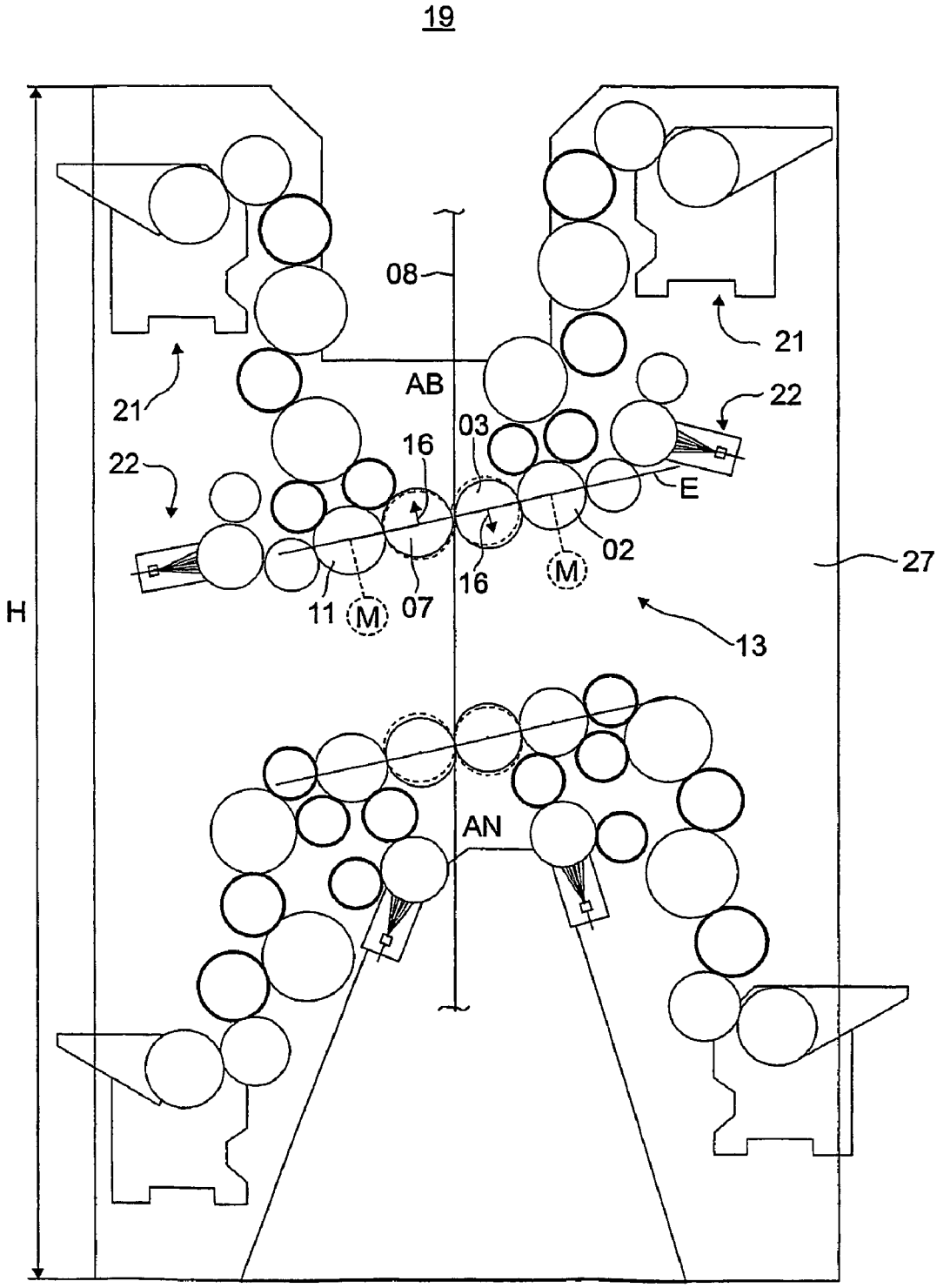
Figure 8:
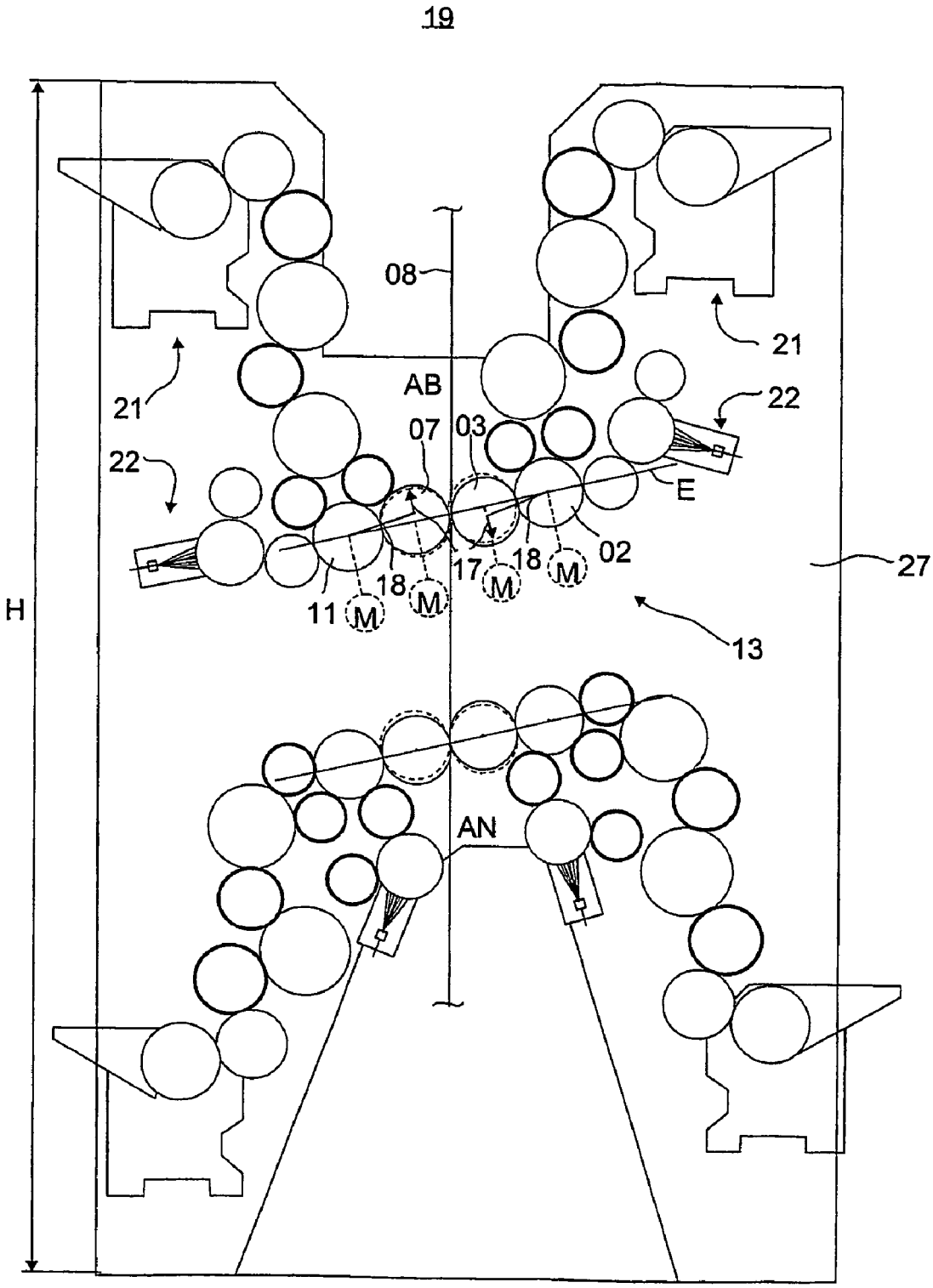

The double printing group 13 can be multiply employed, for example twice, as represented in FIG. 7, in a printing unit 19, for example a so-called H-printing unit 19, in a common lateral frame 27. In FIGS. 7 and 8 a separate identification of the respective parts of the lower located double printing group 13, which parts are identical to those in the upper double printing group 13, is omitted. With an arrangement of all cylinders 02, 03, 07, 11 whose, circumference substantially corresponds to the length of a newspaper page, it is possible to save structural space, i.e. a height "h" of the printing unit 19. This, of course, also applies to individual printing groups 01, 12 for double printing groups 13, as well as for otherwise configured printing units having several printing groups 01, 12. However, an improved accessibility of the cylinders 02, 03, 07, 11, for example for changing dressings, for cleaning work and washing, and for maintenance and the like, can also be a priority in place of, or for accomplishing a savings in height "h".

The print-on, or print-off positions AN, AB have been drawn bold in all drawing figures for the purpose of clarity. In FIG. 7, the transfer cylinders 03, 07 are indicated in dashed lines in a second possible position along the linear setting track 16, wherein here, for example, the upper double printing group 13 is operated in the print-off AB position, shown in solid lines, for example for a printing forme change, and the lower double printing group 13 is operated in the print-on position AN, shown in solid lines, for example for continued printing. The conditions in FIG. 7 are represented in connection with the curved setting track 17 in FIG. 8.

In an advantageous embodiment, each one of the printing groups 01, 12 has at least one drive motor 14 of its own, which is only indicated in dashed lines in FIGS. 7 and 8, for the rotatory driving of the cylinders 02, 03, 07, 11.

In a schematically represented embodiment, shown at the top in FIG. 7, this can be a single drive motor 14 for the respective printing group 01, 12 which, in an advantageous embodiment, in this case initially drives the forme cylinders 02, 11, and power is transferred from there via a mechanical drive connection, for example spur wheels, toothed belts, etc., to the transfer cylinders 03, 07. However, for reasons of space and for reasons of the flow of torque or moments, it can also be of advantage to transfer power from the drive motor 14 to the transfer cylinders 03, 07, and from there to the forme cylinders 02, 11.

The embodiment of the printing group 01, 12 with its own drive motor 14 for each cylinder 02, 03, 07, 11, which is mechanically independent of the remaining drive mechanisms, as shown in FIG. 8 in dashed lines, has a large degree of flexibility in the various operating situations, such as in production printing, registration, dressing changes, washing, web draw-in, etc.

For special requirements, for example for an imprinter operation on only one side, or only for the requirement for a change in the relative angle of rotation position of the cylinders 02, 11 in relation to each other, a drive mechanism is also possible in which one of the forme cylinders 02, 11 of a printing group 01, 12 has its own drive motor M, and the remaining cylinders 02, 03, 07, 11 of the printing group 01, 12 have a common drive motor 14.

The type of the setting movement, as well as of the drive mechanism in FIGS. 7 and 8 are each represented by way of example, and are therefore to be applied to the respective other examples.

In an advantageous embodiment, driving by use of the drive motor 14 takes place coaxially between the rotating shafts R02, R03, R07, R11 and the motor shaft, if required with a coupling for compensating for angles and/or offset, which will be explained in greater detail below. However, it can also take place via a pinion, in case the "moving along" of the motor 14, or a flexible coupling between the drive motor 14 and the cylinders 02, 03, 07, 11, which are to be moved when required, is to be avoided.

If a drive motor 14, which drives the transfer cylinders 03, 07, is to be taken along during the setting movement, it can also be taken along in a further development on an appropriate guide device, for example on the outside of the lateral frame 27.

In a further development of the present invention, it is advantageous if the inking system 21 which is assigned to the respective forme cylinders 02, 11 and, if provided, the associated dampening unit 22, is rotationally driven by a drive motor which is independent of the drive mechanism of the printing group cylinders. The inking system 21, and the possibly provided dampening system 22, can each have their own drive motors. In the case of an anilox inking system 21, the screen roller, and in connection with a roller inking system 21, for example, the friction cylinder or cylinders, can be rotationally driven individually or in groups. Also, the friction cylinder or cylinders of a dampening system 22 can also be rotationally driven individually or in groups.

Figure 9:
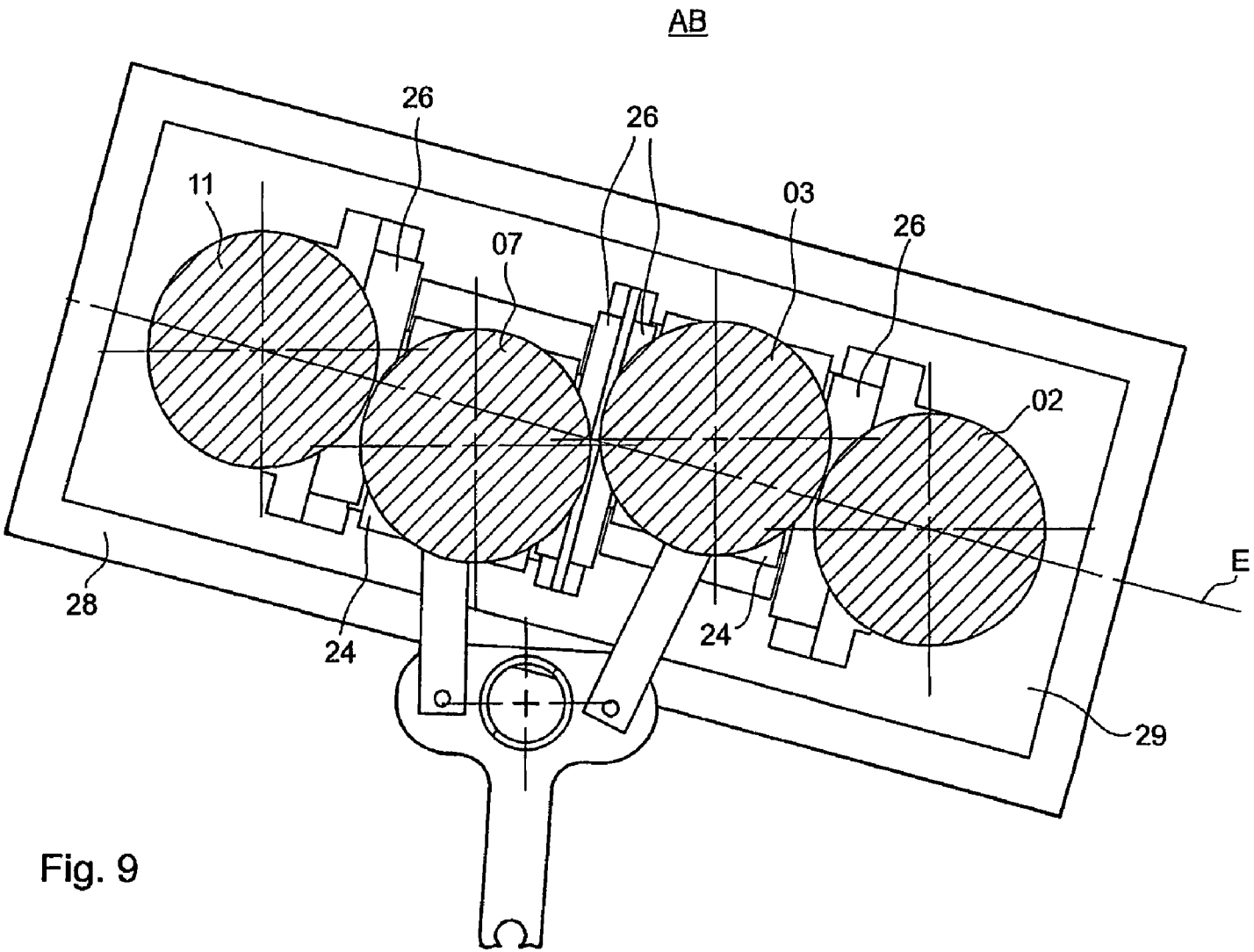
Figure 10:
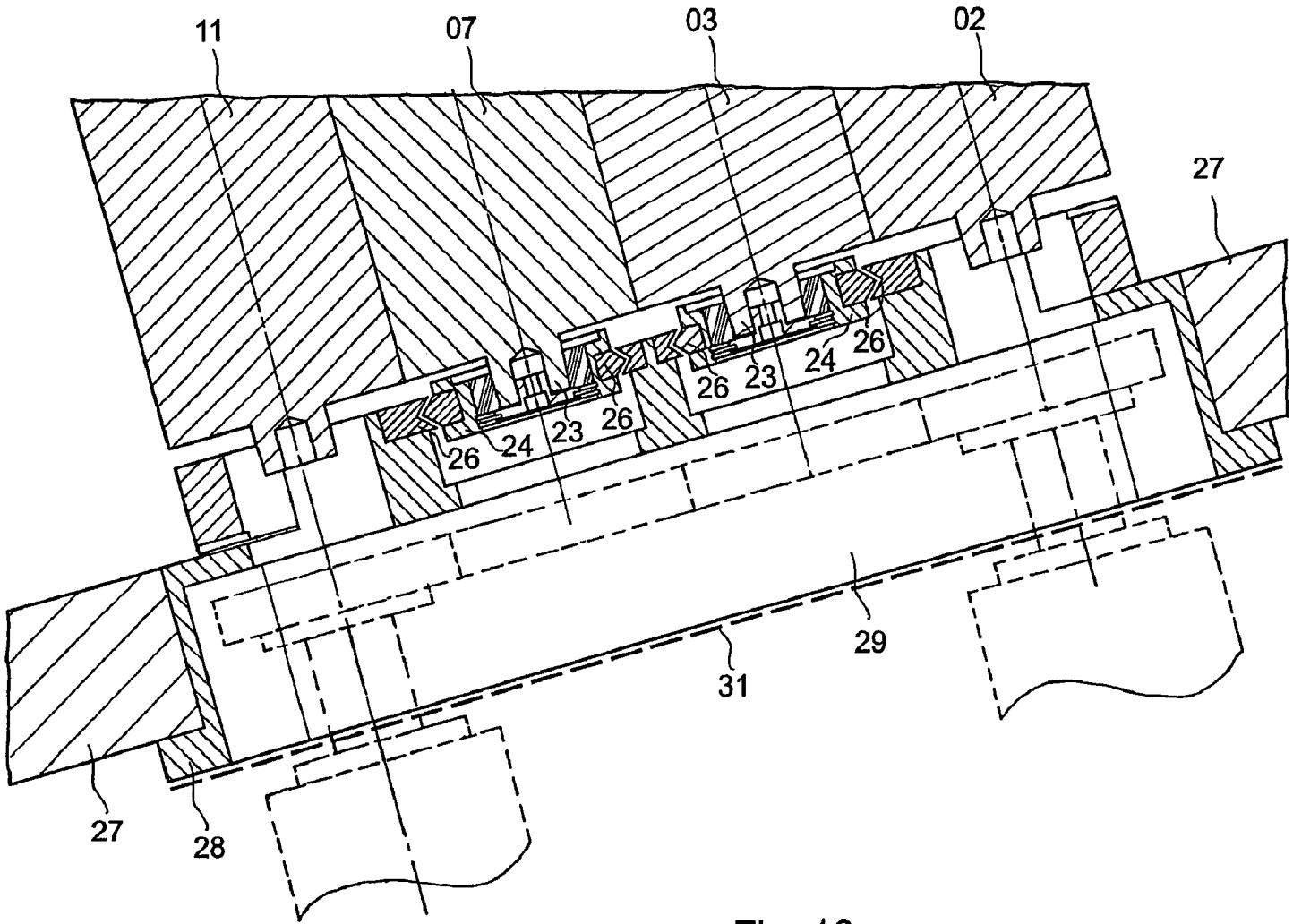

A preferred embodiment for providing the linear setting track 16 by the use of a linear guide device is represented in FIGS. 9 and 10.

The journals 23 of at least one of the transfer cylinders 03, 07 are rotatably seated in radial bearings which are, for example, bearing housings 24 that are embodied as carriages 24. In in FIGS. 9 and 10, only the arrangement in the area of the front faces of the cylinders 02, 03, 07, 11 is represented. The bearing housings 24, or carriages 24, are movable in linear guide devices 26, which are connected with the lateral frame 27.

The linear guide devices 26 are oriented in an advantageous embodiment almost perpendicularly in respect to the plane E. In a preferred embodiment, two linear guide devices 26, which extend parallel with each other, are provided for guiding each bearing housing 24, or carriage 24. The linear guide devices 26 of two adjacent transfer cylinders 03, 07 also preferably extend parallel with each other.

In an embodiment which is not specifically represented, the linear guide devices 26 can be arranged directly on the walls of the lateral frame 27, and in particular on walls of openings in the lateral frame 27 which extend almost perpendicularly to the front faces of the cylinders 02, 03, 07, 11.

In the preferred embodiment in accordance with FIGS. 9 and 10, the lateral frame 27 has an insert 28, for example a so-called bell 28, in an opening. The linear guide devices 26 are arranged on, or in this bell 28.

In an advantageous embodiment, the bell 28 has an area which projects out of the aligned lateral frame 27 in the direction toward the cylinders 02, 03, 07, 11. The linear guide devices 26 are arranged in, or on this area of the bell 28.

The distance between the two oppositely-located lateral frames 27, only one of which is represented is, as a rule, set in accordance with the widest unit, for example the wider inking system 21 and, as a rule, leads to a correspondingly longer journal of the cylinders 02, 03, 07, 11. With the above mentioned arrangement, it is advantageous that it is possible to keep the journals of the cylinders 02, 03, 07, 11 as short as possible.

In a further development, the bell 28 has a hollow chamber 29, which is, at least partially arranged at the height of the alignment of the lateral frame 27. As schematically represented in FIG. 10, the rotatory drive mechanisms of the cylinders 02, 03, 07, 11 are connected with the journals of the cylinders 02, 03, 07, 11 in this hollow chamber 29.

With paired driving of the cylinders 02, 03, 07, 11, driving connections, such as with cooperating spur wheels, for example, it is also possible to arrange driving connections, such as, for example, spur wheels cooperating with each other, between the forme cylinder 02, 11 and the respectively associated transfer cylinder 03, 07. In this case, driving in pairs can preferably take place from the forme cylinders 02, 11 to the transfer cylinders 03, 07. Depending on the requirements, however, driving can be accomplished from the two transfer cylinders 03, 07 to the forme cylinders 02, 11.

If lubrication, for example an oil chamber, is required, the hollow chamber 29 can be bordered in a simple manner by the use of a cover 31, shown in dashed lines, without it increasing the width of the press, or protruding from the frame 27.

Thus, the arrangement of the bell 28 shortens the lengths of the journals, which has a reduction of oscillations as a result, and makes possible a simple and variable construction, which is suitable for the most varied driving configurations and, along with a large degree of structural uniformity, allows the changing between the concepts.

Driving of the respective bearing housings 24, or carriages 24 in the linear guide devices 26 is preferably performed by the use of a respective threaded drive mechanisms, for example a threaded spindle driven by an electric motor. In this case, the electric motor can be controllable in respect to a rotary position.

However, driving of the bearing housing 24 can also take place by the use of a lever mechanism and an electric motor. If the lever mechanism is driven by a cylinder which can be charged with a pressure medium, the arrangement of a synchronizing spindle, which synchronizes the setting movements on both sides I and II, is advantageous.

By the use of the measures explained in the preferred embodiments, it is possible to construct, or to operate a printing group 01, 12 with long, slim cylinders 02, 03, 07, 11, which have a ratio of diameter to length of approximately 0.08 to 0.16, in a rugged and low-oscillation manner, while at the same time requiring little outlay regarding space, operation and frame construction. This applies, in particular, to the operation of forme cylinders 02, 11 of "single circumference", i.e. cylinders with one newspaper page on the circumference, but of double width, i.e. cylinders with four newspaper pages on the length of the cylinders 02, 03, 07, 11, in a rugged and low-oscillation manner, while at the same time requiring little outlay regarding space, operation and frame construction.

The engagement or disengagement of the printing groups 01, 12, 13 takes place as follows:

Starting at the print-off position AB, for example, of both transfer cylinders 03, 07, these cylinders are either simultaneously or sequentially placed towards the printing position 09. The disengagement of the cylinders takes place in a manner opposite to the following discussion.

In a first preferred embodiment, the movement of the transfer cylinders 03, 07 takes place simultaneously and synchronously in the one embodiment of the, for example, linear printing group 01 along a linear setting track 16, or along a curved setting track 17.

If the setting of the two transfer cylinders 03, 07 takes place simultaneously, at least two of the four cylinders 02, 03, 07, 11 are turned, or are charged with a rotatory movement, at least in the near contact area. These cylinders can be the two transfer cylinders 03, 07, or a forme cylinder 02, 11 and the transfer cylinder 07, 03 not working together with them. However, in an advantageous embodiment, all four cylinders 02, 03, 07, 11 can also be rotated during setting. The latter procedure has the advantage that the cylinders maintain their relative angular position with respect to each other and, if grooves are provided, the relative position of these grooves in the circumferential position is maintained. In an advantageous embodiment, the cylinders 02, 03, 07, 11 are not rotated by use of auxiliary drive mechanisms, but by use of their angularly controlled drive motors 14, possibly in pairs via a driving coupling. In one embodiment, the cylinders 02, 03, 07, 11 are driven in pairs at the forme cylinders 02, 11 to accomplish this end. A mechanical driving connection, for example the engagement of gear wheels, between the transfer cylinders 03, 07 and the associated forme cylinders 02, 11 is maintained over the entire setting track 16, 17. However, the driving of the cylinders in pairs can also take place at the transfer cylinders 03, 07, and power is transferred from there to the respective forme cylinder 02, 11.

Turning of the cylinders 02, 03, 07, 11 takes place in a way in which the transfer cylinders 03, 07 turn, or are turned to a large extent, without a relative speed between the touching jacket surfaces of the cylinders 02, 03, 07, 11 between the associated forme cylinder 02, 11 and the cooperating transfer cylinders 07, 03. A corresponding turning-out takes place during disengagement.

This turning movement preferably takes place in such a way that an offset, which is a function of the status, or of the speed of the setting movement, for example in the form of an angular speed or of an angular nominal value, is added to an actual nominal value for the regulation of the angular position of the drive motors.

For example, if the printing group 01, 13 rotates at production speed, for disengaging the double printing group 13, the value of the rotating movement corresponding to the disengagement movement is respectively added, or subtracted, or is added on the one side and is subtracted on the other side, depending on the conveying direction of the web 08 and whether the forme cylinders 02, 11 are disengaged in the same or in the opposite direction with respect to each other.

In connection with the linear embodiment of the double printing group 13 for example as seen in FIG. 7 in particular, the amount of the relative speed, such as angular position or angular speed resulting from the disengagement in the case of the transfer cylinder 07, whose movement during disengagement has a component in the conveying direction of the web 08, is subtracted while, in the case of the transfer cylinder 03, whose movement during disengagement has a component which is anti-parallel to, or opposite to the conveying direction of the web 08, it is added.

For placing the double printing group 13 against a web 08 running at production speed, for example following a flying plate change, or at start-up, the conditions must be applied in accordance with the relative speed resulting from the engagement. The amount of the relative speed, such as angular position or angular speed resulting from the engagement in the case of the transfer cylinder 07, whose movement during disengagement has a component which is anti-parallel to, or opposite to the conveying direction of the web 08, is added while, in the case of the transfer cylinder 03 whose movement during disengagement has a component in the conveying direction of the web 08, it is subtracted.

If the engagement or disengagement takes place while the web 08 is at rest, the above-mentioned amounts are added to the now existing production speed zero, or to a constant nominal value of the angular position.

In a variation, the movement of the two transfer cylinders 03, 07 takes place sequentially, wherein, during the setting of the first of the two transfer cylinders 03, 07, at least the associated forme cylinder 02, 11, or the transfer cylinder 03, 07, or the two associated cylinders 02, 03, or 07, 11 undergo a corresponding turning. When setting the second transfer cylinder 07, 03, either the transfer cylinder 07, 03 to be set, or the remaining three cylinders 02, 03, 07, 11, or all four cylinders 02, 03, 07, 11, turn.

However, for the case that one of the forme cylinders 02, 11, or a pair, is turned, it is advantageous to turn the other forme cylinder 11, 02, or the other pair along with it in order to avoid prior or subsequent registration. To avoid displacements during the roll-off of the cylinders 02, 03, 07, 11 with respect to the grooves 04, 06, it is useful, in the course of synchronous, as well as chronologically offset setting, to turn all of the cylinders 02, 03, 07, 11 in such a way, in respect to each other, that a relative speed on the jacket surface of the cooperating cylinders 02, 03, 07, 11 nearly equals zero.

If the turning of the cylinders 02, 03, 07, 11 and the actuation track 16, 17 are exactly reproducible during disengagement and engagement, it is possible to omit the simultaneous turning of cylinders 02, 03, 07, 11 which are not directly involved in the engagement or disengagement for the purpose of registration and roll-off.

In general, it is possible, in connection with the first preferred embodiment, to provide the engagement or the disengagement of the cylinders 02, 03, 07, 11 or rollers by the coupling of displacement movement or movements and the rotatory drive mechanisms, in that individual cylinders 02, 03, 07, 11 or rollers of a cylinder or a roller arrangement are charged with a torque or torques, or turning movement or movements as a function of the type of the displacement movement or movements in such a way that the frictional force or forces resulting from this or these torque or torques in their nip or nips aid the displacement movement or movements, or do not hinder it, or at least reduce the counteracting frictional forces. In a particularly advantageous embodiment of the present invention, the torque or torques of the drive mechanism or mechanisms is then selected as a function of the type of the displacement movement in such a way, that no relative speed difference between the effective jacket surfaces is created in the nip. Since frictional forces act abrasively on the dressings on the cylinders 02, 03, 07, 11, or the rollers, and also on the web 08 passing through the nip, this embodiment is particularly easy on the material. In the ideal case, the respective cylinders 02, 03, 07, 11 are generally turned, in the course of movements, in such a way, that their or its surface speed, in relation to the web 08, is reduced to zero. This embodiment variation makes it possible to provide a defined angular position of the cylinders 02, 03, 07, 11, or the rollers, in respect to each other toward the end of the movement.

If it is intended to provide a particularly rapid displacement, the torques of the roller drive mechanisms can also be selected in such a way that the frictional forces caused by the displacement movement alone are overcompensated for, i.e. that the friction additionally aids the movement. This variation is advantageous in connection with an emergency stop which may be caused, for example, by a web break and a possible winding.

In a further preferred embodiment, at the start of the movement, the drive mechanisms are shifted to be moment or torquefree. In this case, the turning, or a charge with a rotatory movement of the cylinders 02, 03, 07, 11 or of the rollers is generated by the frictional forces of the nips themselves, which result from the displacement. The advantage of this solution lies in the ease of producing it and in the avoidance of errors in the course of turning the cylinders 02, 03, 07, 11. After renewed generation of the moment and, if necessary, the renewed placement of the cylinders 02, 03, 07, 11 against each other, a deviation in their relative angular position, in respect to each other, might exist. However, this deviation is corrected in pairs, or individually in the course of the first revolutions by operation of the angularly controlled drive motors 14. The relative angular position is thus returned to the nominal values.

In a third preferred embodiment of the present method for engagement or disengagement of cylinders, a chronological ramp is preset for the relative angular position. This means that the cylinder 02, 03, 07, 11, or the pair, are provided with a rotation in accordance with a function based on time, and not as a direct function of a location or of an angle measurement of the setting movement. The rotational movement, or the addition or subtraction is triggered, for example, by the setting command causing the engagement or disengagement.

For the method of the present invention, and in particular in accordance with the first and third preferred embodiments, the transfer cylinder 03, 07 is moved for engagement or for disengagement and is charged with the described turning movement of a defined angular speed or circumferential speed, which compensates for the cylinder movement. A further embodiment is advantageous in which, simultaneously with the charging of the transfer cylinder 03, 07 with this angular speed or circumferential speed, the forme cylinder 02, 11 associated with this transfer cylinder is charged with essentially double the circumferential speed, i.e. with identical circumferences double the angular speed. In the case of individually driven cylinders 02, 03, 07, 11, the drive motors 14 are then appropriately controlled or regulated. In the case of driving the forme and transfer cylinders 02, 03, 07, 11 in pairs, it is advantageous if the drive coupling, which may be, for example, embodied as a gear wheel connection, always remains in engagement during cylinder engagement or disengagement. In this case, the forme cylinder 02, 11, for example, remains fixed in place, while the transfer cylinder 03, 07 is moved. If the driving in pairs takes place at the forme cylinder 02, 11, the angular speed applied at the forme cylinder 02, 11 must essentially be twice as large as is required for the correction of the transfer cylinder 03, 07 with respect to the web 08.

In a configuration of the printing group 13 in which all four cylinders 02, 03, 07, 11 are in a driven connection, for example via gear wheels, it is advantageous if the driven connection between the transfer cylinders 03, 07 also always remains engaged during the engagement or disengagement of the cylinders. In this case, the transfer cylinders 03, 07 are charged with, for example, an angular speed which compensates for the relative speed during the placement process toward or away from the web, while the forme cylinders 02, 11 are charged with essentially double the amount of the resultant circumferential speed i.e. with twice the angular speed with identical circumferences. Driving can take place arbitrarily by use of a drive motor 14 directly at one of the cylinders 02, 03, 07, 11, or by a gear. However, in regard to the control of the speed and/or the angle of rotation position, it is necessary, the same as above, to take into consideration whether the drive motor initially drives a forme cylinder or a transfer cylinder 02, 03, 07, 11.

The previously mentioned preferred embodiment variations, which are also modified by a simple transfer of the principle, for the mode of performing the engagement or disengagement, can also be used in an advantageous manner for printing groups of different types, for example for non-linear bridge printing groups, for u- or n-printing units, for satellite printing units, for printing units for direct printing and for all other printing groups or units in which one or several cylinder are to be placed against one another.

While preferred embodiments of a method for engaging and disengaging cylinders, in accordance with the present invention have been set forth fully and completely hereinabove, it will be apparent to one of skill in the art that various changes in, for example, the type of web being printed, the overall sizes of the cylinders, the controls for the drive motors, and the like could be made without departing from the true spirit and scope of the present invention which is accordingly to be limited only by the following claims.

What is claimed is:

1. A method for selectively engaging and disengaging at least one of a first and a second cylinder with a web which is being conducted between said first cylinder and said second cylinder including: conveying said web in a web conveyance direction at a web conveyance speed; rotating each of said first and second cylinders in said web conveyance direction at a cylinder jacket surface speed equal to said web conveyance speed; supporting at least one of said first and second cylinders for movement, with respect to said web, along a setting track; moving said at least one of said first and second cylinders along said setting track during said selective engagement and disengagement of said at least one cylinder with said web; providing at least one of said first cylinder and said second cylinder, in its near contact area with said web, with a movement component relative to said web conveying direction during said selective engagement and disengagement; applying a rotational movement to said at least one cylinder in said near contact area with said web and forming a resultant actual rotational speed of said at least one cylinder; selecting a direction of said rotational movement for compensating for a relative tangential speed difference between said web and said jacket surface speed of said at least one cylinder; changing said resultant actual speed of said at least one of said first and second cylinders simultaneously with said selective engagement and disengagement; and changing an actual speed of the other of said first and second cylinders simultaneously with said selective engagement and disengagement.

2. The method of claim 1 further including subtracting said rotational movement from said actual speed of one of said first and second cylinders and adding said rotational movement to said actual speed of said other of said first and second cylinders.

3. The method of claim 1 further including changing said actual speeds in accordance with a function based on time.

4. The method of claim 1 further including moving said first and second cylinders in said near contact area in opposite directions.

5. The method of claim 1 further including providing said first and second cylinders as transfer cylinders.

6. The method of claim 5 further including providing a forme cylinder and placing said first and second transfer cylinders against each other and against said forme cylinder in a print-on position.

7. The method of claim 6 further including driving said first and second transfer cylinders and said forme cylinder in pairs.

8. The method of claim 6 further including driving each of said first and second transfer cylinders and said forme cylinder independently.

9. The method of claim 6 further including locating rotating axes of said first and second transfer cylinders and said forme cylinder in a common plane.

10. The method of claim 1 further including simultaneously selectively engaging and disengaging said first and second cylinders.

11. The method of claim 1 further including embodying one of said first and second cylinders as a transfer cylinder and further providing a forme cylinder and assigning said forme cylinder to said transfer cylinder and applying a change in speed of twice said rotation movement to said forme cylinder.

12. The method of claim 11 further including providing separate drive motors for said first and second cylinders and said forme cylinder.

13. The method of claim 11 further including providing a common drive motor for said first and second cylinders and said forme cylinder.

* * * * *